US006111544A

United States Patent [19]

Dakeya et al.

[11] Patent Number: 6,111,544

[45] Date of Patent: Aug. 29, 2000

[54] CHIP ANTENNA, ANTENNA DEVICE, AND MOBILE COMMUNICATION APPARATUS

[75] Inventors: Yujiro Dakeya, Omihachiman; Teruhisa Tsuru, Kameoka; Seiji Kanba, Kusatsu; Tsuyoshi Suesada, Shiga-ken, all of Japan

[73] Assignee: Murata Manufacturing Co., Ltd., Japan

[21] Appl. No.: 09/245,426

[22] Filed: Feb. 4, 1999

[30] Foreign Application Priority Data

| | | | |
|---|---|---|---|
| Feb. 13, 1998 | [JP] | Japan | 10-031392 |
| Jul. 24, 1998 | [JP] | Japan | 10-209515 |
| Sep. 29, 1998 | [JP] | Japan | 10-275831 |

[51] Int. Cl.[7] ..... H01Q 1/38

[52] U.S. Cl. ..... 343/700 MS; 343/702

[58] Field of Search ..... 343/700 MS, 702, 343/846, 848

[56] References Cited

U.S. PATENT DOCUMENTS

| | | | |
|---|---|---|---|
| 4,827,266 | 5/1989 | Sato et al. | 343/700 MS |
| 5,585,810 | 12/1996 | Tsuru et al. | 343/700 MS |
| 5,767,808 | 6/1998 | Robbins et al. | 343/846 |
| 5,898,403 | 4/1999 | Saitoh et al. | 343/700 MS |
| 5,917,450 | 6/1999 | Tsunekawa et al. | 343/700 MS |

*Primary Examiner*—Tan Ho

*Attorney, Agent, or Firm*—Ostrolenk, Faber, Gerb & Soffen, LLP

[57] ABSTRACT

The invention provides a chip antenna comprising: a substrate made by laminating a plurality of sheet layers made of ceramic; a radiating conductor having substantially planar shape and provided on said substrate; a grounding conductor having substantially planar shape and provided so as to oppose said radiating conductor with said sheet layers interposed in between; a capacitor conductor having substantially planar shape and provided so as to oppose said radiating conductor and said grounding conductor with said sheet layers interposed in between; a first shorting conductor which connects said radiating conductor and said grounding conductor; a second shorting conductor which connects said grounding conductor and said capacitor conductor; a feed terminal connected to said radiating conductor or said capacitor conductor; and a ground terminal connected to said grounding conductor. According to the above a chip antenna, the resonance frequency can be adjusted readily with compact size can be achieved.

11 Claims, 9 Drawing Sheets

CHIP ANTENNA, ANTENNA DEVICE, AND MOBILE COMMUNICATION APPARATUS

BACKGROUND OF THE INVENTION

1. Field of the Invention

The present invention relates to chip antennas, antenna devices, and mobile communication apparatus and more particularly to chip antennas, which are compact, flat-shaped antennas that may be used favorably in mobile communication apparatus, such as portable telephones, GPS (Global Positioning System) receivers, etc., and antenna devices and mobile communication apparatus.

2. Description of the Related Art

In recent years, compact size and light weight have come to be increasingly demanded of portable telephones, GPS receivers, and other mobile communication apparatus, and compact size is thus being demanded of parts used in such equipment. Since the antenna is a relatively large part among such component parts, compact size is being demanded of antennas in particular.

Given such circumstances, flat antennas, represented by microstrip antennas and one-side shorted microstrip antennas, have come to be developed as small antennas in accompaniment with the advancement of mobile communication apparatus. Among such antennas, the inverted F antenna 80, shown in FIG. 16, uses a dielectric ceramic substrate and is known as an antenna with which significant compactness can be achieved. The inverted F antenna 80 is provided with a substrate 81, made of a dielectric ceramic having magnesium oxide, calcium oxide, and titanium oxide as the main components thereof and with a relative dielectric constant of 20. Here, inverted F antenna 80 has a shape for example of 13.0 mm length×13.0 mm width×6.0 mm height. Metal conducting films of copper are deposited onto the upper and lower surfaces of substrate 81 respectively to form a radiating conductor 82 and a grounding conductor 83. A shorting conductor 84, which is of predetermined width and is made of a metal conducting film of copper that shorts radiating conductor 82 and grounding conductor 83, is formed by deposition on the side surface of ceramic substrate 81. Also in order to feed to this inverted F antenna 80, a feed conductor 85 is provided so as to extend from a prescribed position of radiating conductor 82 and along the side face of substrate 81. In using such an inverted F antenna 80, the grounding conductor 83 at the lower surface of substrate 81 is set to contact for example the metal chassis of a portable telephone so as to use the antenna as a receiving-only antenna. In this case, inverted F antenna 80 operates as a microstrip type inverted F antenna. With such an inverted F antenna, the following relationship holds for the resonance frequency f;

$$f=1/(2\pi\cdot(LC)^{1/2})$$

where L is the inductance component of the radiating conductor and C is the capacitance component between the radiating conductor and the grounding conductor, and for example, the resonance frequency in the case of inverted F antenna 80 (FIG. 16) will be approximately 800 MHz.

However, with the conventional inverted F antenna described above, when the resonance frequency is to be made lower to enable use down to the low frequency range, the capacitance component between the radiating conductor and the grounding conductor has to be made large, and for this, the interval between the radiating conductor and the grounding conductor had to be made extremely narrow, thus presenting the problem of requiring precision in manufacture.

Also due to restrictions in the precision of manufacture of the interval between the radiating conductor and the grounding conductor, a limit was placed on the capacitance component between the radiating conductor and the grounding conductor, thus giving rise to the problem of the range of variation of the resonance frequency being narrow.

SUMMARY OF THE INVENTION

To overcome the above described problems, the preferred embodiments of the present invention provide a compact chip antenna, antenna device, and mobile communication apparatus with which the resonance frequency can be adjusted readily and with which a wide bandwidth can be achieved.

One preferred embodiment of the present invention provides a chip antenna, comprising: a substrate made by laminating a plurality of sheet layers made of ceramic;

a radiating conductor having substantially planar shape and provided on said substrate; grounding conductor having substantially planar shape and provided so as to oppose said radiating conductor with said sheet layers interposed in between; a capacitor conductor having substantially planar shape and provided so as to oppose said radiating conductor and said grounding conductor with said sheet layers interposed in between; a first shorting conductor which connects said radiating conductor and said grounding conductor; a second shorting conductor which connects said grounding conductor and said capacitor conductor; a feed terminal connected to said radiating conductor or said capacitor conductor; and a ground terminal connected to said grounding conductor.

According to the above described chip antenna, since a capacitor conductor having substantially planar shape is provided so as to oppose a radiating conductor with sheet layers, that comprise a substrate, interposed in between, the capacitance value of the capacitance component of the chip antenna may be adjusted readily in the design stage by adjusting the interval between the radiating conductor and the capacitor conductor or by adjusting the area of the capacitor conductor. The resonance frequency of the chip antenna can thus be adjusted readily in the design stage and the deviation of the resonance frequency from the design value can be prevented.

Also since the capacitor conductor has substantially planar shape, the area thereof can be varied greatly. Since the capacitance value of the capacitance component of the chip antenna can thus be varied greatly, the variable range of the resonance frequency of the chip antenna can be made wide.

Furthermore by adjusting the inductance component of a first shorting conductor, which connects the radiating conductor and the grounding conductor, just the inductance value of the inductance component can be adjusted without varying the resonance frequency of the chip antenna. Impedance matching of the chip antenna with an external circuit can thus be performed readily.

In the above chip antenna, a plurality of the radiating conductors may be =provided and at least one of the above described radiating conductors may be fed.

According to the above described structure and arrangement, a strong electric field is generated near the radiating conductor which is fed and an electric current can be made to flow by means of this electric field to the unfed radiating conductors.

Thus by the current that flows to the unfed radiating conductors, the radiating conductor that is fed and the unfed radiating conductors are made to resonate simultaneously.

Since the chip antenna can thus be provided with a plurality of resonance frequencies just by feeding to at least one radiating conductor, the chip antenna can be provided with a plurality of resonance frequencies and with a wide band.

The preferred embodiment of the present invention also provides an antenna device comprising an above-described chip antenna and a mounting circuit board, provided with a protruding part that extends from the end part thereof, and characterized in that the above-mentioned chip antenna is mounted to one of the main surfaces of the above-mentioned protruding part and a ground electrode is provided on the other main surface of the above-mentioned mounting circuit board.

According to the above described antenna device, since a protruding part is extended from the end portion of a mounting circuit board and the shape of a ground electrode near the location at which a chip antenna is mounted is made small, the leaky electromagnetic waves from the radiating conductor are increased and the radiation resistance of the antenna device can thus be made large.

Thus in the process of matching the input impedance of the antenna device with the characteristic impedance of the mobile communication apparatus to which the antenna device is mounted, since the inductance component L of the first shorting conductor of the chip antenna, which is a matching element, is made large, the $Q(=k(C/L)^{1/2})$ of the first shorting conductor is made small and the bandwidth of the antenna device can thus be made wide.

Also since the current distribution on the ground electrode of the mounting circuit board, which comprises the antenna device, can be controlled by providing the mounting circuit board with the protruding part, the directivity of the antenna device can be controlled.

Furthermore since a mounting circuit board is provided that has the ground electrode provided on the other main surface, the influence of the antenna characteristics on a human body, etc. that approaches from the ground electrode side can be restricted.

The preferred embodiment of the present invention also provides an antenna device comprising an above-described chip antenna and a mounting circuit board, having the above-mentioned chip antenna mounted on one of the main surfaces thereof and having a ground electrode provided on the other main surface thereof, and characterized in that the ground electrode is provided with a gap part near the location at which the chip antenna is mounted.

According to the above described antenna device, since the ground electrode is provided with a gap part and the shape of the ground electrode near the location at which the chip antenna is thereby made small, the leaky electromagnetic waves from the radiating conductor are increased and the radiation resistance of the antenna device can thus be made large.

Thus in the process of matching the input impedance of the antenna device with the characteristic impedance of the mobile communication apparatus to which the antenna device is mounted, since the inductance component L of the first shorting conductor of the chip antenna, which is a matching element, is made large, the $Q(=k(C/L)^{1/2})$ of the first shorting conductor is made small and the bandwidth of the antenna device can thus be made wide.

Also since the current distribution on the ground electrode of the mounting circuit board, which comprises the antenna device, can be controlled by providing the ground electrode of the mounting circuit board with a gap part, the directivity of the antenna device may be controlled.

Furthermore since a mounting circuit board is provided that has the ground electrode provided on the other main surface, the influence of the antenna characteristics on a human body, etc. that approaches from the ground electrode side can be restricted.

The preferred embodiment of the present invention also provides a mobile communication apparatus characterized in that an above-described antenna device is used.

According to the above described mobile communication apparatus, since an antenna device equipped with a wide bandwidth or an antenna device with which the directivity can be controlled is used, wide bandwidths and control of directivity can be realized in mobile communication apparatus.

Other features and advantages of the present invention will become apparent from the following description of the invention which refers to the accompanying drawings.

BRIEF DESCRIPTION OF DRAWINGS

FIGS. 14A and 16B are a partially perspective bottom view of the current distribution on the ground electrode of the substrate that comprises the antenna device.

DESCRIPTION OF THE PREFERRED EMBODIMENTS

Figure 1:
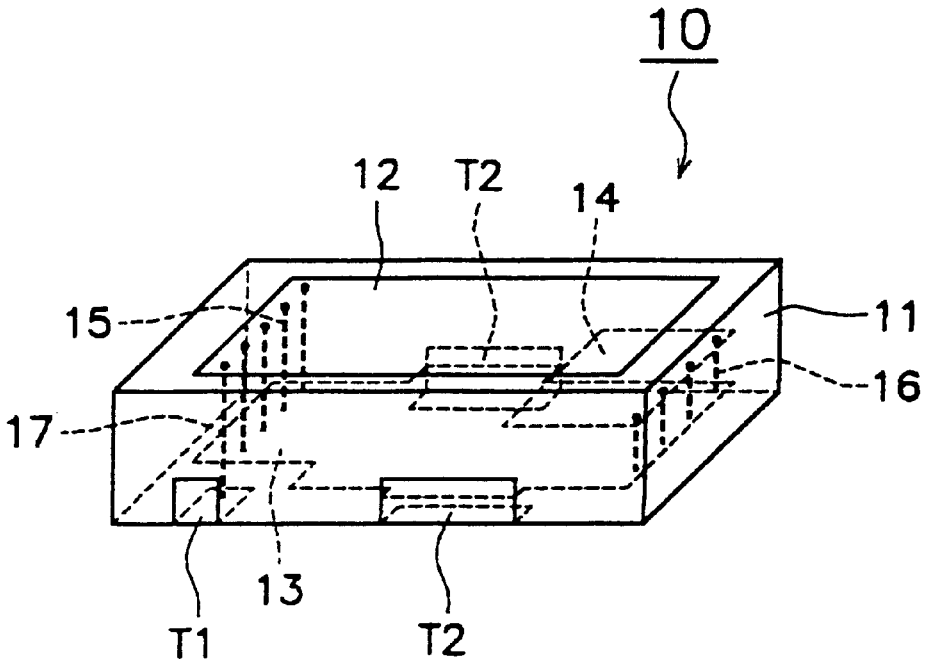
FIG. 1 is a perspective view of the first preferred embodiment of the chip antenna of the present invention.

FIG. 1 is a perspective view of a first preferred embodiment of the chip antenna of the present invention. A chip antenna 10 is comprised of a substrate 11 of rectangular parallelepiped shape, a planar radiating conductor 12, which is provided on one of the main surfaces of substrate 11, a planar grounding conductor 13, which is provided on the other main surface side at the interior of substrate 11 so as to oppose radiating conductor 12, a planar capacitor conductor 14, which is provided between radiating conductor 12 and grounding conductor 13 so as to oppose radiating conductor 12, first shorting conductors 15, which are provided in the interior of substrate 11 to connect radiating conductor 12 and grounding conductor 13, second shorting conductors 16, which are provided in the interior of substrate 11 to connect grounding conductor 13 and capacitor conductor 14, a feed terminal T1, which is provided from the side surface of substrate 11 to the other main surface and is connected to radiating conductor 12 via a connecting conductor 17 that is provided in the interior of substrate 11 and a ground terminal T2, which is provided from the side surface of substrate 11 to the other main surface and is connected to grounding conductor 13 at the side surface of substrate 11.

Figure 2:
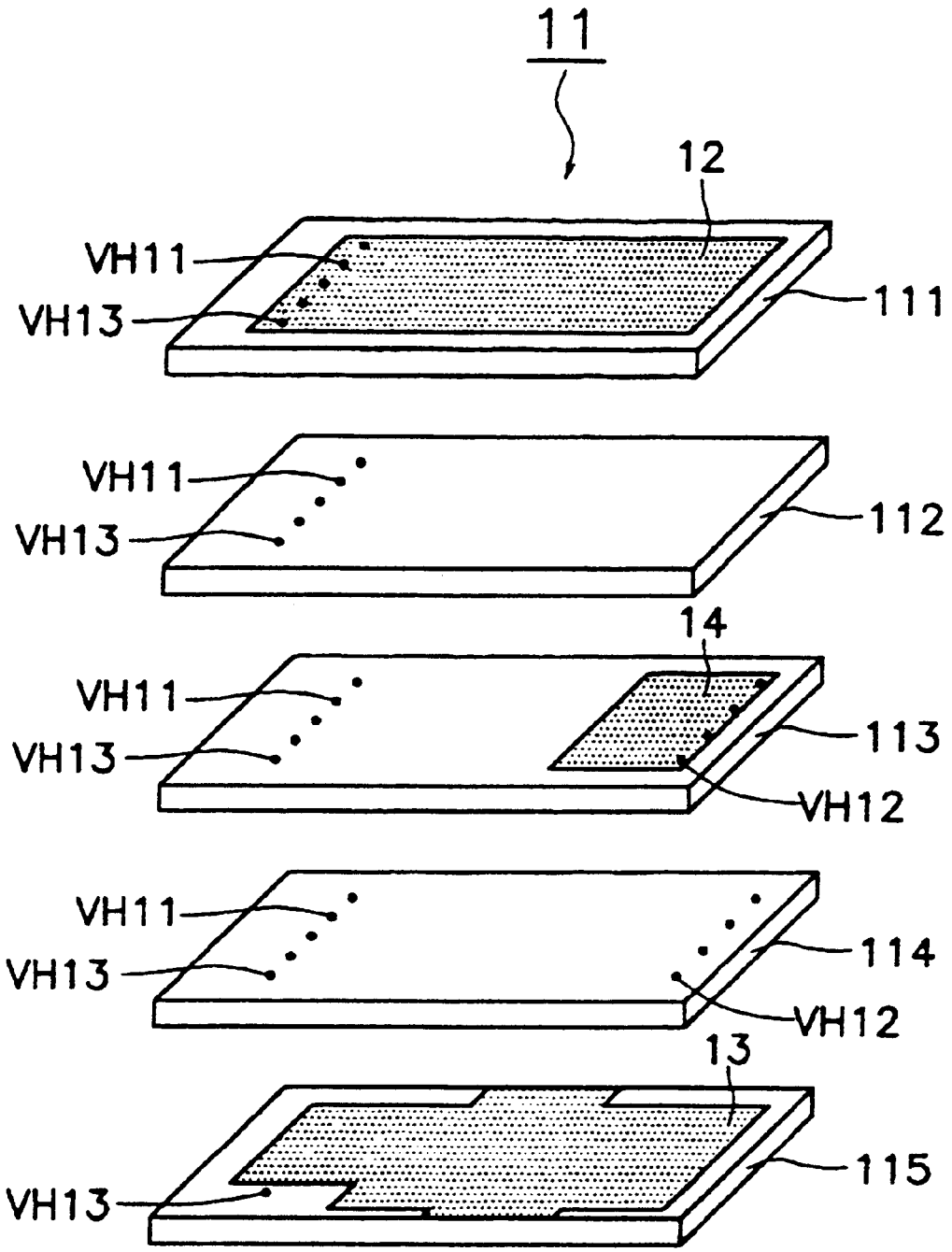
FIG. 2 is an exploded perspective view of the substrate that comprises the chip antenna of FIG. 1.

FIG. 2 is an exploded perspective view of substrate 11 that comprises chip antenna 10 of FIG. 1. A substrate 11 is formed by laminating rectangular sheet layers 111 to 115, made of a dielectric ceramic having barium oxide, aluminum oxide, and silica as the main components thereof. Among these sheet layers, sheet layer 111 has a planar radiating conductor 12, formed from copper or copper alloy and having a substantially rectangular shape, provided over nearly its entire surface by screen printing, vapor deposition, or plating.

Also near one end portion of the short edge side of sheet layer 113, a planar capacitor conductor 14, formed from copper or copper alloy and having a substantially rectangular shape, is provided by screen printing, vapor deposition, or plating. Furthermore, sheet layer 115 has a planar grounding conductor 13, formed from copper or copper alloy and having a substantially rectangular shape, provided over nearly its entire surface by screen printing, vapor deposition, or plating, and portions of grounding conductor 13 are drawn out towards both end parts of the long edge side of sheet layer 115.

Also at prescribed positions of sheet layers 111 to 114, via holes VH11, that connect the radiating conductor 12 on sheet layer 111 and the grounding conductor 13 on sheet layer 115, are provided in the thickness direction. These via holes VH11 become the first shorting conductors 15, shown in FIG. 1, for connecting radiating conductor 12 and grounding conductor 13.

Furthermore at prescribed positions of sheet layers 113 and 114, via holes VH12, that connect the capacitor conductor 14 on sheet layer 113 and the grounding conductor 13 on sheet layer 115, are provided in the thickness direction. These via holes VH12 become the second shorting conductors 16, shown in FIG. 1, for connecting grounding conductor 13 and capacitor conductor 14.

Also at prescribed positions of sheet layers 111 to 115, via holes VH13, that connect the radiating conductor 12 on sheet layer 111 and a feed terminal (not shown), which is provided from the side surface of substrate 11 to the other main surface, are provided in the thickness direction. These via holes VH13 become the connecting conductor 17, shown in FIG. 1, for connecting radiating conductor 12 and feed terminal T1.

And by laminating sheet layers 111 to 115 and sintering, a substrate 11 is formed that is provided on one main surface or in the interior thereof with radiating conductor 12, grounding conductor 13, capacitor conductor 14, first shorting conductors 15, second shorting conductors 16, and connecting conductor 17.

Figure 3:
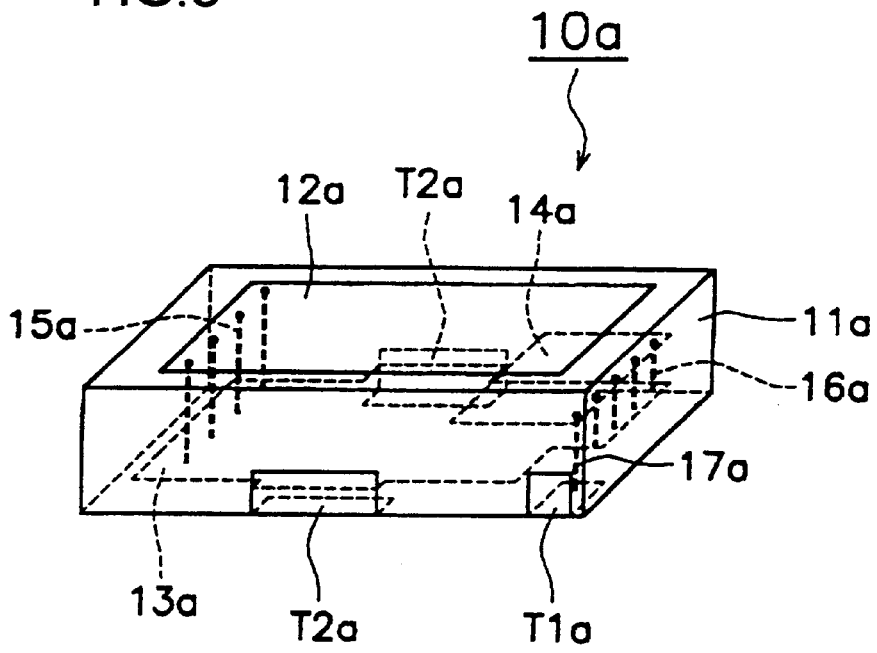
FIG. 3 is a perspective view of a modification of the chip antenna of FIG. 1.
Figure 4:
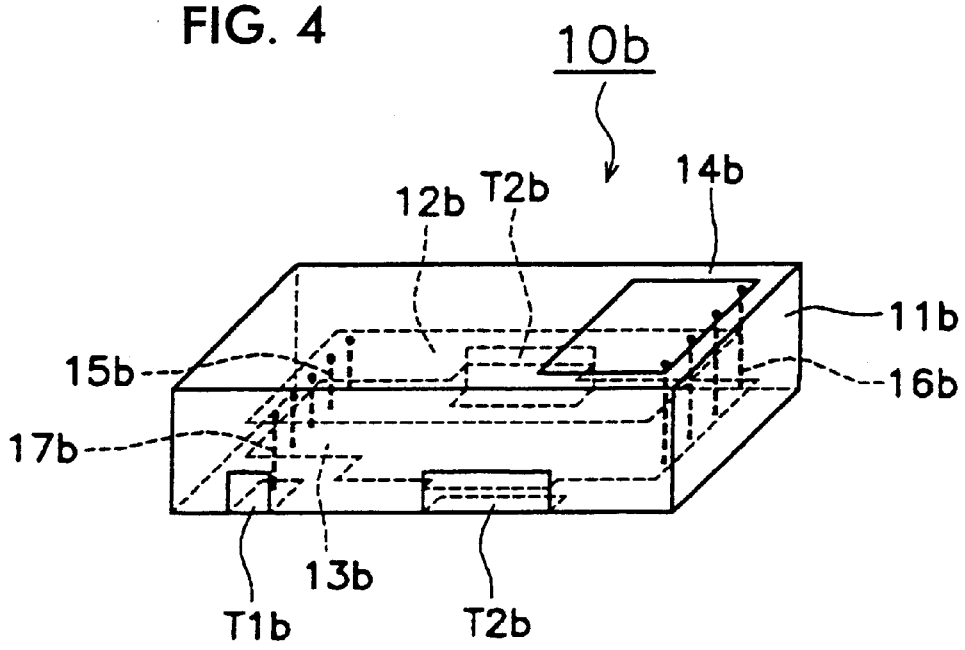
FIG. 4 is a perspective view of another modification of the chip antenna of FIG. 1.
Figure 5:
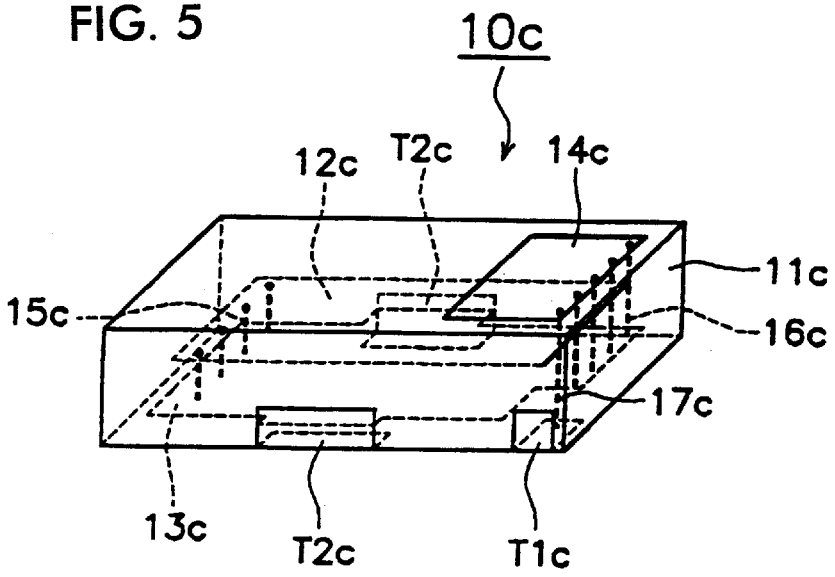
FIG. 5 is a perspective view of yet another modification of the chip antenna of FIG. 1.

FIGS. 3 to 5 are perspective views of modifications of chip antenna 10. A chip antenna 10*a* of FIG. 3 is comprised of a substrate 11*a* of rectangular parallelepiped shape, a planar radiating conductor 12*a*, which is provided on one of the main surfaces of substrate 11*a*, a planar grounding conductor 13*a*, which is provided on the other main surface side at the interior of substrate 11*a* so as to oppose radiating conductor 12*a*, a planar capacitor conductor 14*a*, which is provided between radiating conductor 12*a* and grounding conductor 13*a* so as to oppose radiating conductor 12*a*, first shorting conductors 15*a*, which are provided in the interior of substrate 11*a* to connect radiating conductor 12*a* and grounding conductor 13*a*, second shorting conductors 16*a*, which are provided in the interior of substrate 11*a* to connect grounding conductor 13*a* and capacitor conductor 14*a*, a feed terminal T1*a*, which is provided from the side surface of substrate 11*a* to the other main surface and is connected to radiating conductor 12*a* via a connecting conductor 17*a* that is provided in the interior of substrate 11*a*, and a ground terminal T2*a*, which is provided from the side surface of substrate 11*a* to the other main surface and is connected to grounding conductor 13*a* at the side surface of substrate 11*a*.

Chip antenna 10*b* of FIG. 4 is comprised of a substrate 11*b* of rectangular parallelepiped shape, a planar capacitor conductor 14*b*, which is provided on one of the main surfaces of substrate 11*b*, a planar grounding conductor 13*b*, which is provided on the other main surface side at the interior of substrate 11*b* so as to oppose capacitor conductor 14*b*, a planar radiating conductor 12*b*, which is provided between grounding conductor 13*b* and capacitor conductor 14*b* so as to oppose capacitor conductor 14*b*, first shorting conductors 15*b*, which are provided in the interior of substrate 11*b* to connect radiating conductor 12*b* and grounding conductor 13*b*, second shorting conductors 16*b*, which are provided in the interior of substrate 11*b* to connect grounding conductor 13*b* and capacitor conductor 14*b*, a feed terminal T1*b*, which is provided from the side surface of substrate 11*b* to the other main surface and is connected to radiating conductor 12*b* via a connecting conductor 17*b* that is provided in the interior of substrate 11*b*, and a ground terminal T2*b*, which is provided from the side surface of substrate 11*b* to the other main surface and is connected to grounding conductor 13*b* at the side surface of substrate 11*b*.

A chip antenna 10*c* of FIG. 5 is comprised of a substrate 11*c* of rectangular parallelepiped shape, a planar capacitor conductor 14*c*, which is provided on one of the main surfaces of substrate 11*c*, a planar grounding conductor 13*c*, which is provided on the other main surface side at the interior of substrate 11*c* so as to oppose capacitor conductor 14*c*, a planar radiating conductor 12*c*, which is provided between grounding conductor 13*c* and capacitor conductor 14*c* so as to oppose capacitor conductor 14*c*, first shorting conductors 15*c*, which are provided in the interior of substrate 11*c* to connect radiating conductor 12*c* and grounding conductor 13*c*, second shorting conductors 16*c*, which is provided in the interior of substrate 11*c* to connect grounding conductor 13*c* and capacitor conductor 14*c*, a feed terminal T1*c*, which is provided from the side surface of substrate 11*c* to the other main surface and is connected to radiating conductor 12*c* via a connecting conductor 17*c* that is provided in the interior of substrate 11*c*, and a ground terminal T2*c*, which is provided from the side surface of substrate 11*c* to the other main surface and is connected to grounding conductor 13*c* at the side surface of substrate 11*c*.

In particular with the chip antennas 10*b* and 10*c* of FIGS. 4 and 5, since each of the capacitor conductors 14*b* and 14*c* is provided on one of the main surfaces of the corresponding substrate 11*b* or 11*c*, the trimming of capacitor conductor 14 is made easy and the area of capacitor conductor 14 can thus be adjusted more readily.

Figure 6A:
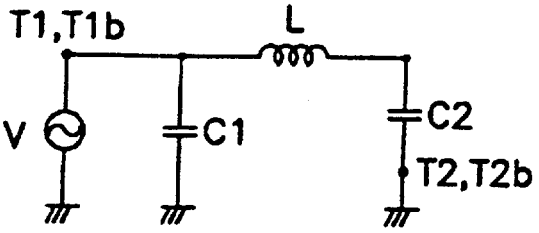
FIG. 6A is a circuit diagram of an equivalent circuit of the chip antennas of FIGS. 1 and 4.
Figure 6B:
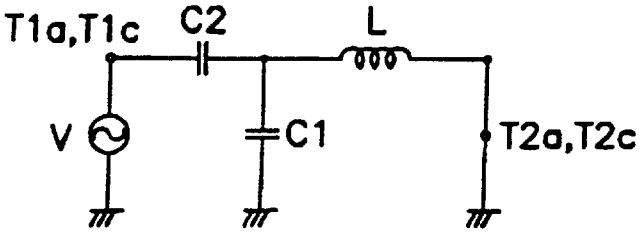
FIG. 6B is a circuit diagram of an equivalent circuit of the chip antennas of FIGS. 3 and 5.

FIGS. 6A and 6B show equivalent circuits of chip antennas 10 and 10*a* to 10*c* of FIG. 1 and FIGS. 3 to 5. Each of the equivalent circuits of chip antennas 10 and 10*a* to 10*c* is comprised of an inductance component L and capacitance components C1 and C2, with each inductance component L being comprised of the corresponding inductance components of radiating conductor 12, 12*a*, 12*b*, or 12*c* and first shorting conductors 15, i5*a*, 15*b*, or 15*c*, each capacitance component C1 being comprised of the corresponding floating capacitance across radiating conductor 12, 12*a*, 12*b*, or 12*c* and grounding conductor 13, 13*a*, 13*b*, or 13*c*, and each capacitance component C2 being comprised of the corresponding electrostatic capacitance across radiating conductor 12, 12*a*, 12*b*, or 12*c* and capacitor conductor 14, 14*a*, 14*b*, or 14*c*.

With chip antennas 10 and 10*b*, since feed terminal T1 is connected to the corresponding radiating conductor 12 or 12*b* via connecting conductor 17 or 17*b*, the capacitance component C2, which is comprised of the corresponding electrostatic capacitance across radiating conductor 12 or 12*b* and capacitor conductor 14 or 14*b*, is formed between the inductance component L, comprised of the corresponding inductance components of radiating conductor 12*a* or 12*c* and first shorting conductors 15*a* or 15*c*, and the ground as shown in FIG. 6A.

Meanwhile with chip antennas 10*a* and 10*c*, since feed terminal T1 is connected to the corresponding capacitor conductor 14*a* or 14*c* via grounding conductor 17*a* or 17*c*, the capacitance component C2, which is comprised of the corresponding electrostatic capacitance across radiating conductor 12*a* or 12*c* and capacitor conductor 14*a* or 14*c*, is formed between the inductance component L, comprised of the corresponding inductance components of radiating conductor 12*a* or 12*c* and first shorting conductors 15*a* or 15*c*, and the feed source V as shown in FIG. 6B.

The above-described equivalent circuits (FIGS. 6A and 6B) show that since the capacitance values of capacitance components C2 of chip antennas 10 and 10*a* to 10*c* may be adjusted readily by adjusting the area of the corresponding capacitor conductors 14 and 14*a* to 14*c*, the resonance frequencies of chip antennas 10 and 10*a* to 10*c* can be adjusted readily.

It can also be understood that since the inductance values of inductance components L of chip antennas 10 and 10*a* to 10*c* can be adjusted readily by adjusting the inductance component of the corresponding first shorting conductors 15 and 15*a* to 15*c*, impedance matching with an external circuit, such as the high-frequency unit, etc., of mobile communication apparatus having chip antenna 10, 10*a*, 10*b*, or 10*c* mounted therein, may be achieved readily.

The above points shall now be explained by way of an actually manufactured chip antenna of 5.0 mm length×15.0 mm width×3.0 mm height.

Figure 7:
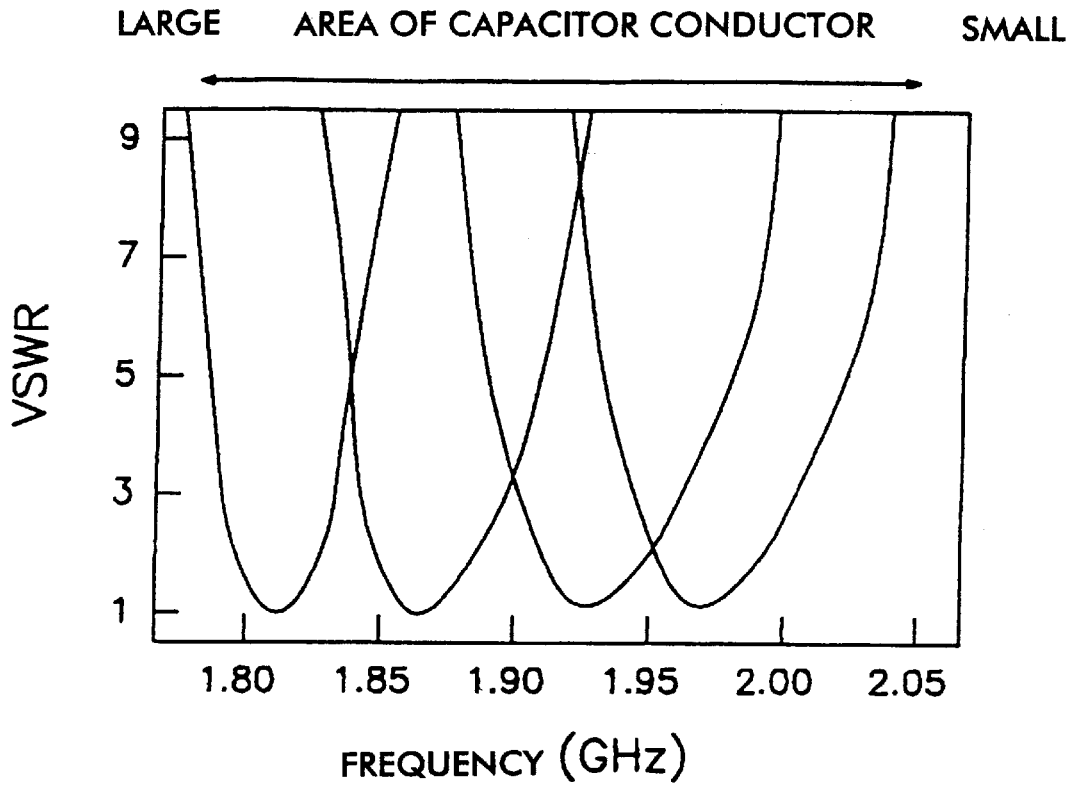
FIG. 7 is a graph showing the variation of the resonance frequency of the chip antenna of FIG. 1.

FIG. 7 is a graph that shows the variation of the resonance frequency of chip antenna 10. This graph shows the results of investigation of the relationship between the area of capacitor conductor 14 and the resonance frequency of chip antenna 10. This graph shows that as the area of capacitor conductor 14 is made smaller, that is, as the capacitance value of capacitance component C2 of chip antenna 10 is made smaller, the resonance frequency of chip antenna 10 is made higher.

This shows that the resonance frequency of chip antenna 10 may be adjusted readily by adjusting the area of capacitor conductor 14. It also shows that the resonance frequency of chip antenna 10 can be adjusted readily by adjusting the area of capacitor conductor 14 by trimming capacitor conductor 14 with a laser, etc.

It can also be understood that the VSWR (Voltage Standing Wave Ratio) at the resonance frequency of chip antenna 10 is 1.2 or less and thus that good antenna characteristics are exhibited. This shows that the adjustment of the area of capacitor conductor 14 for the adjustment of the resonance frequency of chip antenna 10 does not have an influence on the antenna characteristics of chip antenna.

The variation of the characteristic impedance of chip antenna 10 is shown in Table 1. This Table shows the results of investigation of the relationship between the number of shorting conductors 14 that have been disconnected and the characteristic impedance of chip antenna 10.

TABLE 1

| Number of first shorting conductors that have been disconnected | Resonance frequency (GHz) | Characteristic impedance Z(Ω) R | Characteristic impedance Z(Ω) X |
|---|---|---|---|
| 0 | 1.94 | 15.6 | 38.0 |
| 1 | 1.94 | 35.4 | 41.3 |
| 2 | 1.93 | 54.1 | 26.4 |
| 3 | 1.93 | 53.2 | 2.35 |

*The characteristic impedance is given by Z = R + iX (Ω).

The above Table shows that as the number of disconnected first shorting conductors 15, that connect radiating conductor 12 and grounding conductor 13, is increased, that is, as the inductance component of first shorting conductors 15, which comprises inductance component L (FIG. 6) of chip antenna 10, is increased, the conditions R=50 and X=0 are approached for the characteristic impedance (Z=R+iX) of chip antenna 10, that is, the characteristic impedance Z is brought closer to 50 (Ω). In this process, the resonance frequency of chip antenna 10 hardly varies.

Since the characteristic impedance of a high-frequency unit or other external circuit of mobile communication apparatus equipped with chip antenna 10 is generally 50(Ω), impedance matching of the chip antenna with the external circuit can be achieved by bringing the characteristic impedance of the chip antenna close to 50. This shows that impedance matching of chip antenna 10 with an external circuit may be achieved readily by adjusting the inductance value of inductance component L of chip antenna 10.

As has been described above, with the chip antenna of the first embodiment, since a substantially planar capacitor conductor is provided so as to oppose the radiating conductor with sheet layers, that comprise the substrate, interposed in between, the capacitance value of the capacitance component of the chip antenna may be adjusted readily by adjusting the interval between the radiating conductor and the capacitor conductor or the area of the capacitor conductor. The resonance frequency of the chip antenna can thus be adjusted readily by adjusting the interval between the radiating conductor and the capacitor conductor or the area of the capacitor conductor.

Since the interval between the radiating conductor and the capacitor conductor may be adjusted readily by varying the thickness of the sheet layers provided between the radiating conductor and the capacitor conductor, interval can be determined at the design stage. The area of the capacitor conductor can also be determined at the design stage. The determination of the capacitance value of the capacitance component of the chip antenna at the design stage, which was not possible with the conventional inverted F antenna, is thus made possible and the deviation of the resonance frequency of the chip antenna from the design value can be prevented.

Also since the capacitor conductor is substantially planar, its area can be varied greatly. Since the capacitance value of the capacitance component of the chip antenna can thus be varied greatly, the range of variation of the resonance frequency of the chip antenna can be widened.

Furthermore by adjusting the inductance component of the first shorting conductors that connect the radiating conductor and the grounding conductor, just the inductance value of the inductance component can be adjusted without varying the resonance frequency of the chip antenna. Impedance matching of the chip antenna with an external circuit can thus be achieved readily.

Figure 8:
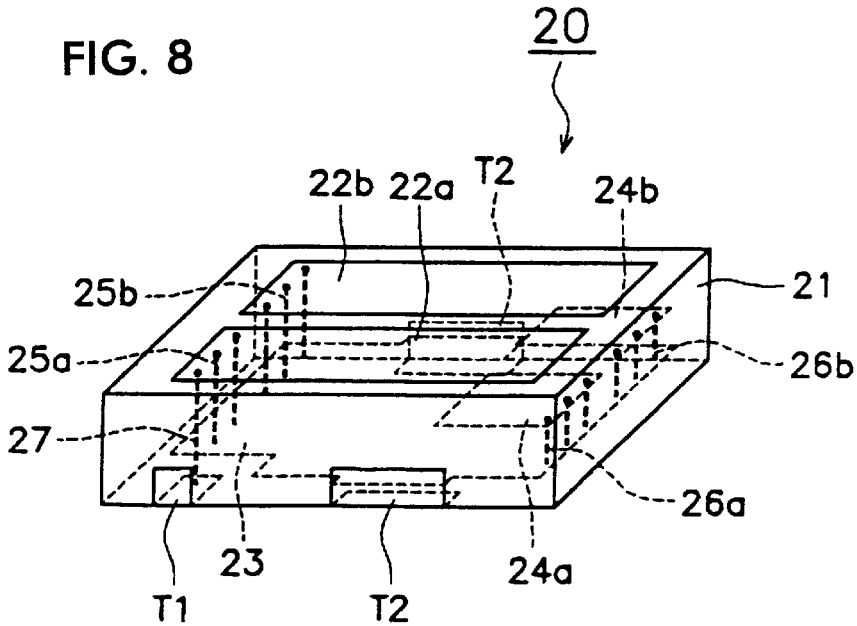
FIG. 8 is a perspective view of the second preferred embodiment of the chip antenna of the present invention.

FIG. 8 is a perspective view of a second preferred embodiment of the chip antenna by the present invention. Chip antenna 20 is comprised of a substrate 21 of rectangular parallelepiped shape, two planar radiating conductors 22*a* and 22*b*, which are provided on one of the main surfaces of substrate 21, a planar grounding conductor 23, which is provided on the other main surface side at the interior of substrate 11 so as to oppose radiating conductors 22*a* and 22*b*, two planar capacitor conductors 24*a* and 24*b*, which are provided between radiating conductors 22*a* and 22*b* and grounding conductor 23 so as to oppose radiating conductors 22*a* and 22*b*, respectively, first shorting conductors 25*a* and 25*b*, which are provided in the interior of substrate 21 to connect radiating conductors 22*a* and 22*b* and grounding conductor 23, second shorting conductors 26*a* and 26*b*, which are provided in the interior of substrate 21 to connect grounding conductor 23 and capacitor conductors 24*a* and 24*b*, a feed terminal Ti, which is provided from the side surface of substrate 21 to the other main surface and is connected to just one radiating conductor 22*a* via a connecting conductor 27 that is provided in the interior of substrate 21, and a ground terminal T2*c*, which is provided from the side surface of substrate 21 to the other main surface and is connected to grounding conductor 23 at the side surface of substrate 21.

Figure 9:
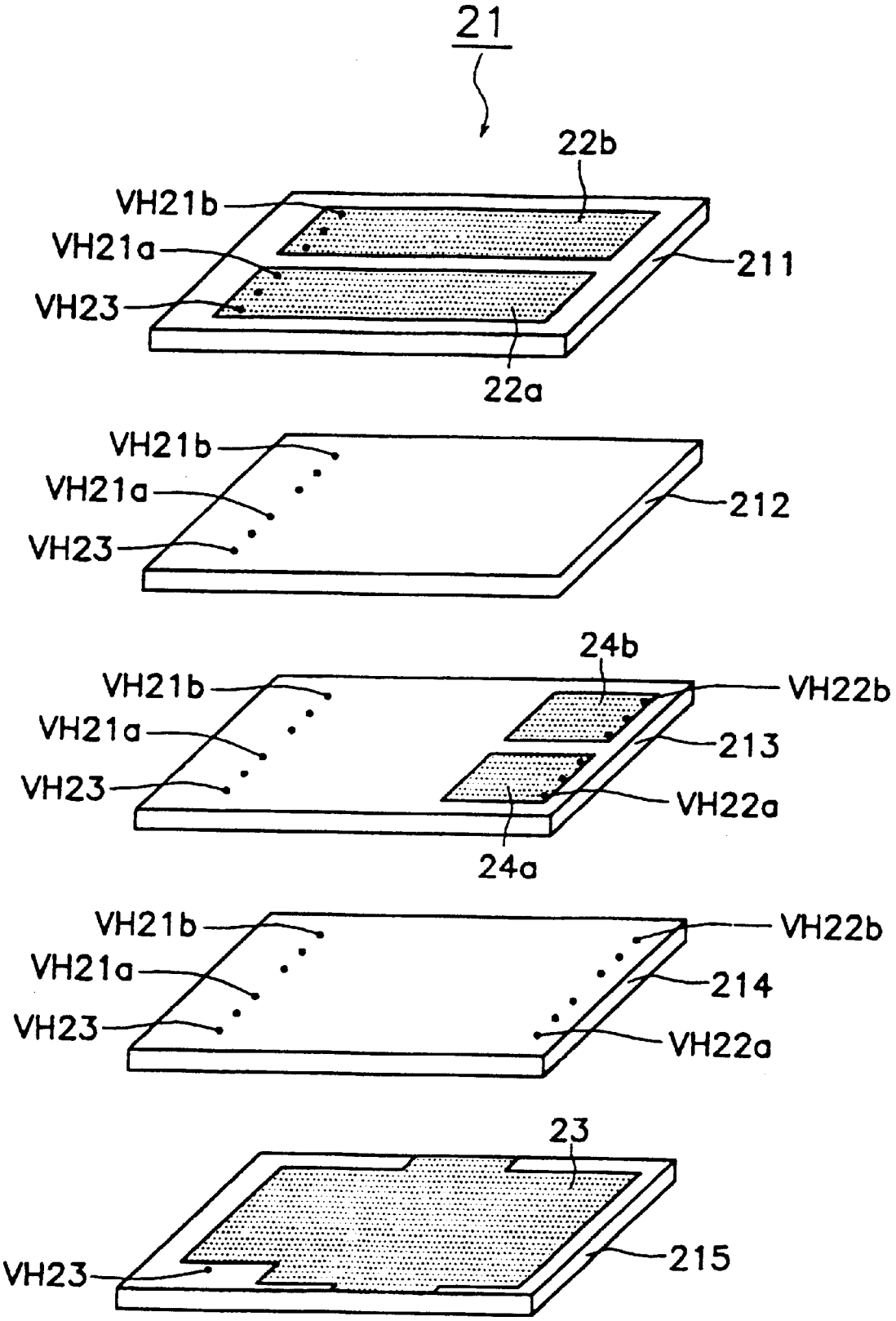
FIG. 9 is an exploded perspective view of the substrate that comprises the chip antenna of FIG. 8.

FIG. 9 is an exploded perspective view of substrate 21 that comprises chip antenna 20 of FIG. 8. A substrate 21 is made by laminating rectangular sheet layers 211 to 215, made of a dielectric ceramic having barium oxide, aluminum oxide, and silica as the main components thereof. Among these sheet layers, sheet layer 211 has two planar radiating conductors 22*a* and 22*b*, formed from copper or copper alloy and having a substantially rectangular shape, provided near the respective end portions of the long edge side by screen printing, vapor deposition, or plating.

Also near one end portion of the short edge side of sheet layer 213, two planar capacitor conductors 24*a* and 24*b*, formed from copper or copper alloy and having a substantially rectangular shape, are provided by screen printing, vapor deposition, or plating. Furthermore, sheet layer 215 has a planar grounding conductor 23, formed from copper or copper alloy and having a substantially rectangular shape, provided over nearly its entire surface by screen printing, vapor deposition, or plating, and portions of grounding conductor 23 are drawn out towards both end parts of the long edge side of sheet layer 215.

Also at prescribed positions of sheet layers 212 to 215, via holes VH21*a* and VH21*b*, that connect the radiating conductors 22*a* and 22*b* on sheet layer 215 and the grounding conductor 23 on sheet layer 215, are provided in the thickness direction. These via holes VH21*a* and VH21*b* become the first shorting conductors 25*a* and 25*b*, shown in FIG. 8, for connecting radiating conductors 22*a* and 22*b* and grounding conductor 23.

Furthermore at prescribed positions of sheet layers 213 and 214, via holes VH22*a* and VH22*b*, that connect the capacitor conductors 24*a* and 24*b* on sheet layer 213 and the grounding conductor 23 on sheet layer 215, are provided in the thickness direction. These via holes VH22*a* and VH22*b* become the second shorting conductors 26*a* and 26*b*, shown in FIG. 8, for connecting grounding conductor 23 and capacitor conductors 24*a* and 24*b*.

Also at prescribed positions of sheet layers 211 to 215, via holes VH23, that connect one radiating conductor 22*a* on sheet layer 211 and a feed terminal (not shown), which is provided from the side surface of substrate 21 to the other main surface, are provided in the thickness direction. These via holes VH23 become the connecting conductor 27, shown in FIG. 8, for connecting radiating conductor 22 and feed terminal T1.

And by laminating sheet layers 211 to 215 and sintering, a substrate 21 is formed that is provided on one main surface or in the interior thereof with two radiating conductors 22*a* and 22*b*, grounding conductor 23, two capacitor conductors 24*a* and 24*b*, first shorting conductors 25*a* and 25*b*, and second shorting conductors 26*a* and 26*b*.

Figure 10:
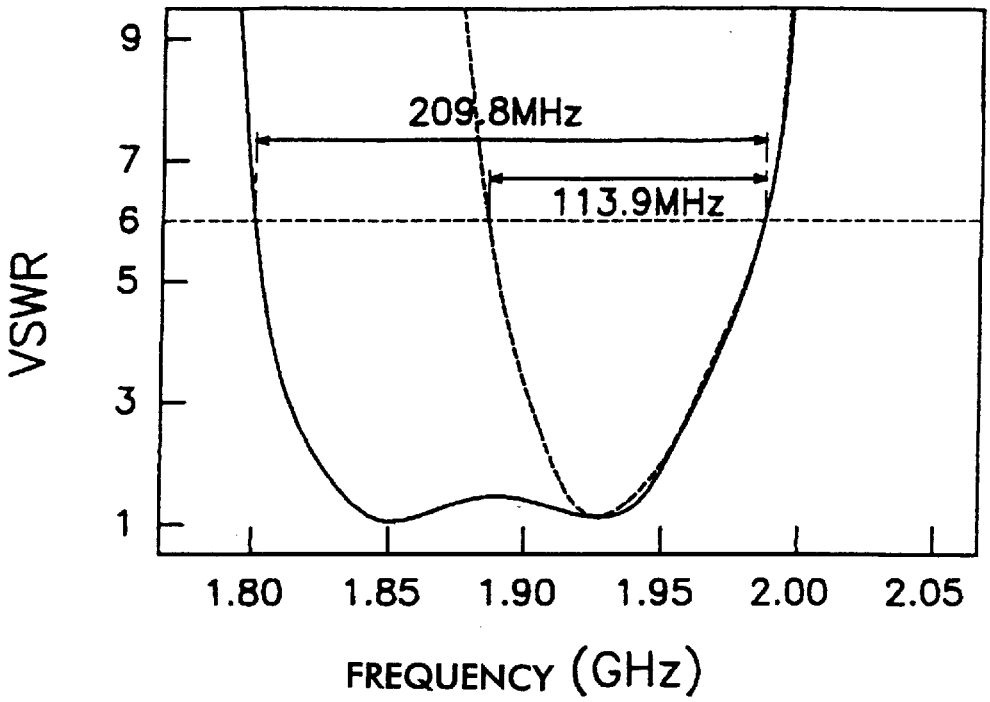
FIG. 10 is a graph that shows the resonance frequencies of the chip antenna of FIG. 8.

FIG. 10 is a graph that shows the frequency characteristics of chip antenna 20. In FIG. 10, the solid line indicates the characteristics of chip antenna 20 (FIG. 8) and the broken line indicates the characteristics of chip antenna 10 (FIG. 1) for comparison. This diagram shows that chip antenna 20 has two resonance frequencies and a wider bandwidth in comparison to chip antenna 10. For example, a comparison of the bandwidths for VSWR<3 show that whereas the bandwidth is approximately 113.9 MHz with chip antenna 10 (FIG. 1), the bandwidth is approximately 209.8 MHz or approximately 85(%) wider with chip antenna 20 (FIG. 8).

Furthermore it can be understood that, as with chip antenna 10, good antenna characteristics are exhibited, with the VSWR at the resonance frequency being 1.2 or less.

As has been described above, with the chip antenna of the second preferred embodiment, by providing two radiating conductors and connecting only one of the radiating conductors to the feed terminal so that just one of the radiating conductors is fed, a strong electric field is generated near one of the radiating conductors and electric current can be made to flow to the other radiating conductor by this electric field.

As a result, the one radiating conductor and the other radiating conductor can be made to resonate simultaneously by making current flow to the other radiating conductor and the chip antenna may thereby be made to have a plurality of resonance frequencies and, in accompaniment, a wide bandwidth, just by feeding to one radiating conductor.

Also since just one of the radiating conductors is fed, the voltage necessary for feeding may be made low.

Figure 11:
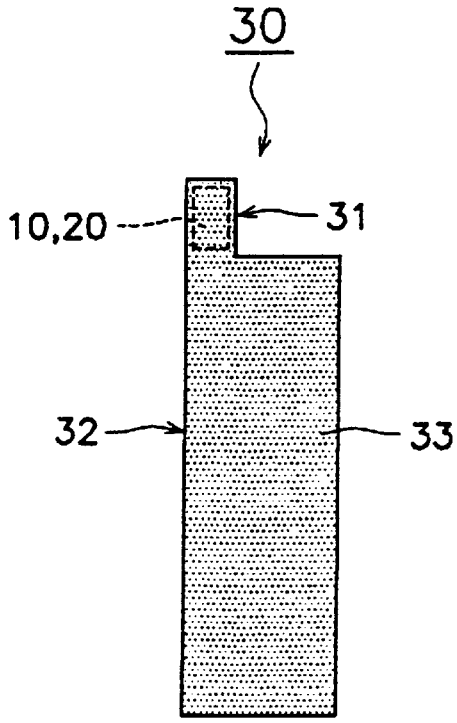
FIG. 11 is a perspective bottom view of the first preferred embodiment of the antenna device of the present invention.

FIG. 11 is a perspective bottom view of a first preferred embodiment of the antenna device by the present invention. Antenna device 30 is comprised of the antenna device 10 of FIG. 1 or the antenna device 20 of FIG. 8 and a mounting circuit board 32 from which a protruding part 31 is extended from its end portion. On one of the main surfaces of protruding part 31, in other words, on the same surface as one of the main surfaces of mounting circuit board 32 is mounted chip antenna 10, and on the other main surface of mounting circuit board 32 is provided a ground electrode 33.

Figure 12:
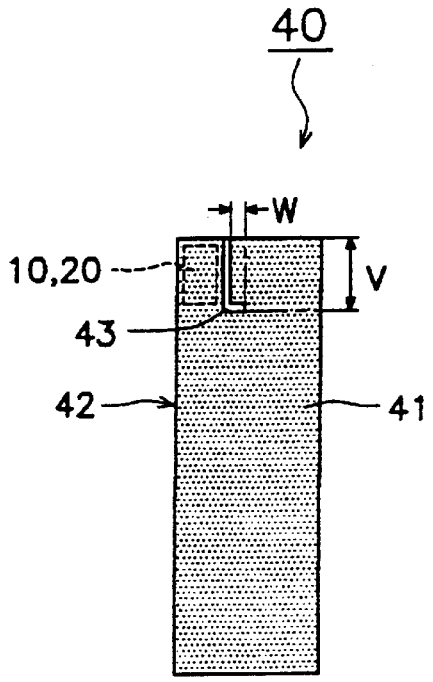
FIG. 12 is a perspective bottom view of the second preferred embodiment of the antenna device of the present invention.

FIG. 12 is a perspective bottom view of a second preferred embodiment of the antenna device by the present invention. Antenna device 40 is comprised of the antenna device 10 of FIG. 1 or the antenna device 20 of FIG. 8 and a mounting circuit board 42, having a chip antenna 10 mounted to one main surface and a ground electrode 41 provided on the other main surface. The ground electrode 41 that is provided on the other main surface of mounting circuit board 42 has a substantially L-shaped gap part 43, which is a portion at which ground electrode 41 is not provided, near the location where chip antenna 10 is mounted.

Figure 13:
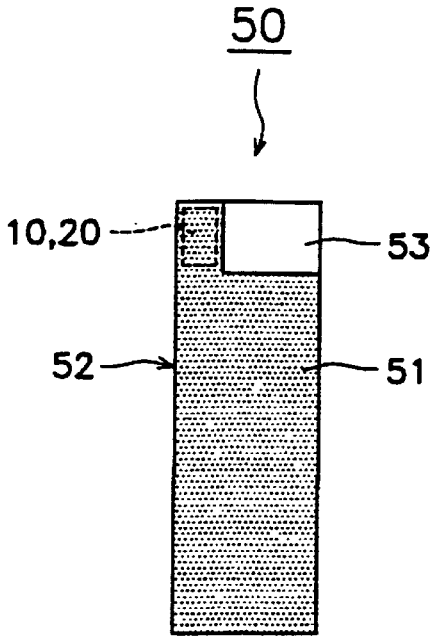
FIG. 13 is a perspective bottom view of the third preferred embodiment of the antenna device of the present invention.

FIG. 13 is a perspective bottom view of a third preferred embodiment of the antenna device by the present invention. Antenna device 50 is comprised of the antenna device 10 of FIG. 1 or the antenna device 20 of FIG. 8 and a mounting circuit board 52, having a chip antenna 10 mounted to one main surface and a ground electrode 51 provided on the other main surface. The ground electrode 51 that is provided on the other main surface of mounting circuit board 52 has a wide, substantially rectangular gap part 53 near the location at which chip antenna 10 is mounted. That is, in comparison to antenna device 40 of the second embodiment, the area of gap part 53, which is provided to ground electrode 51 that is provided on the other main surface of mounting circuit board 52, is made greater.

Table 2 shows the bandwidths of antenna devices 30 to 50 of the above-described first to third preferred embodiments for the case where chip antenna 10 of FIG. 1 is used. In Table 2, the comparative example is a device in which chip antenna 10 of FIG. 1 is mounted on a rectangular mounting circuit board provided with a ground electrode over the entire surface of the other main surface thereof.

TABLE 2

| | Antenna device 30 | Antenna device 40 | Antenna device 50 | Comparative Example |
|---|---|---|---|---|
| Bandwidth (MHz) | 123.0 | 121.0 | 92.0 | 70.1 |

*The bandwidth is the frequency range in which the VSWR (Voltage Standing Wave Ratio) is 3 or less.

These results show that as the shape of the ground electrode near the location at which the chip antenna is mounted is made smaller, that is, as the ground electrode smaller, the bandwidth of the antenna device is made wider.

That is, the bandwidth becomes wider in the order of the comparative example, antenna device 40, in which a substantially L-shaped gap part is provided near the location at which the chip antenna is mounted, antenna device 50, in which a wide, substantially rectangular gap part is provided near the location at which the chip antenna is mounted, and antenna device 30, in which a protruding part is provided at the end portion of the mounting circuit board and the chip antenna is mounted to this protruding part.

Table 3 shows the bandwidths of antenna devices 30 to 50 of the above-described first to third preferred embodiments for the case where chip antenna 20 of FIG. 8 is used. In Table 3, the comparative example is a device in which chip antenna 30 of FIG. 8 is mounted onto a rectangular mounting circuit board provided with a ground electrode over the entire surface of the other main surface thereof.

TABLE 3

| | Antenna device 30 | Antenna device 40 | Antenna device 50 | Comparative Example |
|---|---|---|---|---|
| Bandwidth (MHz) | 162.3 | 159.3 | 137.4 | 107.2 |

*The bandwidth is the frequency range in which the VSWR (Voltage Standing Wave Ratio) is 3 or less.

These results also show that as the shape of the ground electrode near the location at which the chip antenna is mounted is made smaller, the bandwidth of the antenna device is made wider.

That is, the bandwidth becomes wider in the order of the comparative example, antenna device 40, in which a substantially L-shaped gap part is provided near the location at which the chip antenna is mounted, antenna device 50, in which a wide, substantially rectangular gap part is provided near the location at which the chip antenna is mounted, and antenna device 30, in which a protruding part is provided at the end portion of the mounting circuit bard and the chip antenna is mounted to this protruding part.

The reason for the above may be explained as follows. That is, by extending a protruding part from the end portion of the mounting circuit board or by providing a gap part in the ground electrode, the shape of the ground electrode near the location at which the chip antenna is mounted is made smaller.

Since the leaky electromagnetic waves from the radiating conductor are thus increased and the radiation resistance of the antenna device is made greater, the inductance component L of the first shorting conductors of the chip antenna, which comprise a matching element, must be made greater in order to match the input impedance of the antenna device with the characteristic impedance of the mobile communication apparatus to which the antenna device is mounted.

As a result, the $Q(=k(C/L)^{1/2})$ of the first shorting conductors is made smaller and since the frequency characteristics are thus widened, an antenna device comprising a chip antenna provided with first shorting conductors of small Q is made wide in bandwidth.

Table 4 shows the bandwidths for cases where the length direction dimension a and width direction dimension b of the substantially L-shaped gap part are varied in the above-described antenna device 40 of the second embodiment.

TABLE 4

| | | | | | | |
|---|---|---|---|---|---|---|
| V [mm] | 0 | 6 | 12 | 18 | 18 | 18 |
| W [mm] | 0 | 0 | 0 | 0 | 2 | 4 |
| Bandwidth (MHz) | 76.4 | 78.8 | 80.6 | 86.6 | 89.5 | 92.0 |

These results show that as the size of the gap part is made greater and the shape of the ground electrode near the location at which the chip antenna is mounted is made smaller, the bandwidth of the antenna device is made wider. The reason for this is the same as that explained above for the cases of Tables 2 and 3.

Figure 14A:
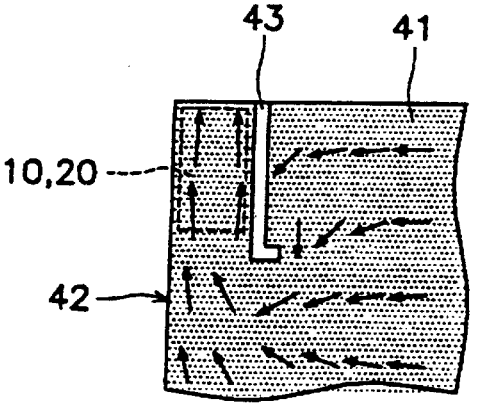
Figure 14B:
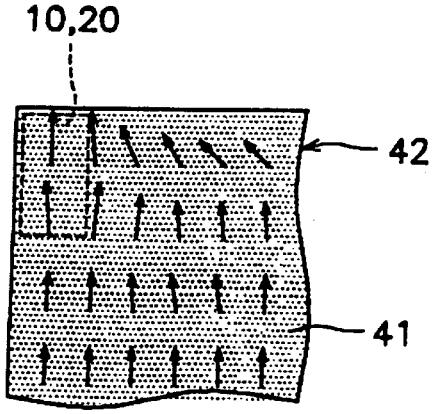

FIG. 14 is a partially perspective bottom view of the current distribution on the ground electrode of a mounting circuit board that comprises an antenna device. FIG. 14A shows the current distribution for the case where the V and W of gap part 43 of ground electrode 41 in the antenna device 40 of FIG. 12 are set to 22 mm and 2 mm, respectively, and FIG. 14B shows the current distribution for the comparative case where ground electrode 41 is not provided with gap part 43, that is, for the case of a solid electrode. In FIGS. 14A and 14B, the directions of the arrows indicate the directions of the current and the lengths of the arrows indicate the magnitudes of the current.

These results show that whereas in the case where ground electrode 41 is not provided with a gap part 43 (FIG. 14B) the current is distributed nearly parallel to the length direction of chip antenna 10 or 20, in the case where ground electrode 41 is provided with gap part 43 (FIG. 14A), the current is distributed nearly perpendicular to the length direction of chip antenna 10 or 20 at the location at the side of gap part 43 opposite the mounting position of chip antenna 10 or 20.

This shows that the current distribution on ground electrode 41 of mounting circuit board 42, which comprises antenna device 40, is changed by the provision of ground electrode 41 with gap part 43.

This therefore shows that by providing ground electrode 41 with gap part 43, the current distribution on ground electrode 41 of mounting circuit board 42, which comprises antenna device 40, can be controlled and thus the directivity of antenna device 40 can be controlled. With the antenna device of FIG. 14A, a measurement of the directivity of the antenna device showed that the polarized wave in the direction perpendicular to the length direction of chip antenna 10 or 20 was strong and the polarized wave in the parallel direction was weak.

The control of the current distribution on the ground electrode of the mounting circuit board that comprises the antenna device may be carried out in likewise manner in the antenna device 30 of FIG. 11 which is provided with a protruding part and in the antenna device 50 of FIG. 13 in which a wide, substantially rectangular gap part is provided. The directivity may thus be controlled in likewise manner in antenna devices 30 and 50.

With the antenna devices of the first to third embodiments described above, since the shape of the ground electrode near the location at which the chip antenna is mounted is made smaller by extending a protruding part from the end portion of the mounting circuit board or by providing the ground electrode with a gap part, the leaky electromagnetic waves from the radiating conductor are increased, and as a result, the radiation resistance of the antenna device can be made greater.

Thus in the process of matching the input impedance of the antenna device with the characteristic impedance of the mobile communication apparatus to which the antenna device is mounted, since the inductance component L of the first shorting conductor of the chip antenna, which is a matching element, is made large, the $Q(=k(C/L)^{1/2})$ of the first shorting conductor is made small and the bandwidth of the antenna device can thus be made wide. As a result, a wide bandwidth can be realized in mobile communication apparatus equipped with this antenna device.

Also since the current distribution on the ground electrode of the mounting circuit board, which comprises the antenna device, can be controlled by providing the mounting circuit board with a protruding part or by providing the ground electrode of the mounting circuit board with a gap part, the directivity of the antenna device can be controlled. Control of directivity can thus be realized in mobile communication apparatus equipped with this antenna device.

Furthermore since a mounting circuit board having a ground electrode provided on the other main surface is provided, the influence of the antenna characteristics on a human body, etc. that approaches from the ground electrode side can be restricted.

Although cases in which the substrate is comprised of a dielectric ceramic having barium oxide, aluminum oxide, and silica as the main components thereof were described with the chip antennas of the first and second preferred embodiments, the substrate is not limited to being a dielectric ceramic and may be a dielectric ceramic having titanium oxide and neodymium oxide as the main components thereof, a magnetic ceramic having nickel, cobalt, and iron as the main components thereof, or a combination of a dielectric ceramic and a magnetic ceramic.

Also, although cases in which the radiating conductor, capacitor conductor, and grounding conductor have a substantially rectangular shape were described, this shape is not limited thereto and the same effects may be obtained with a substantially circular shape, substantially elliptical shape, or polygonal shape, etc. as long as the shape is planar.

Furthermore, although cases in which one of either the radiating conductor or the capacitor conductor is provided in the interior of the substrate were described, the same effects may be obtained in cases where both the radiating conductor and the capacitor conductor are provided in the interior of the substrate.

Also, although cases in which the grounding conductor is provided in the interior of the substrate were described, the same effects may be obtained in cases where the grounding conductor is provided on the other main surface of the substrate.

Furthermore, although cases in which the first and second shorting conductors are provided in the interior of the substrate were described, the same effects may be obtained in cases where these conductors are provided on a main surface or side surface of the substrate.

Also, although the case in which the feed terminal is connected to the radiating conductor was described with the chip antenna of the second preferred embodiment, the same effects may be obtained in cases where the feed terminal is connected to the capacitor conductor as in a modification of the first preferred embodiment.

Furthermore, although the case in which two radiating conductors are provided on one main surface of the substrate was described, a plurality of radiating conductors may be equipped and since as the number of radiating conductors is increased, the number of resonance frequencies can be increased in accordance with the number of radiating conductors, a chip antenna with a wider bandwidth may be realized.

Also, although a wide bandwidth may be realized by feeding to the plurality of radiating conductors, the voltage necessary for feeding may be lowered more significantly if the number of radiating electrodes that are fed is made fewer.

Figure 15A:
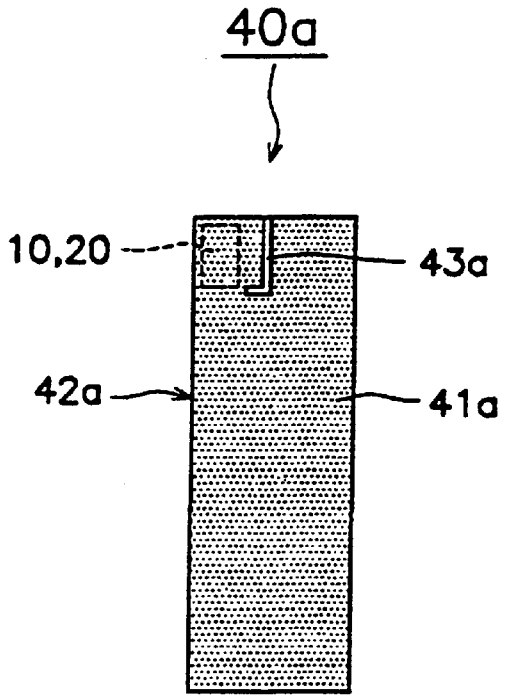
FIG. 15A is a perspective bottom view of a modification of the antenna device of FIG. 12
Figure 15B:
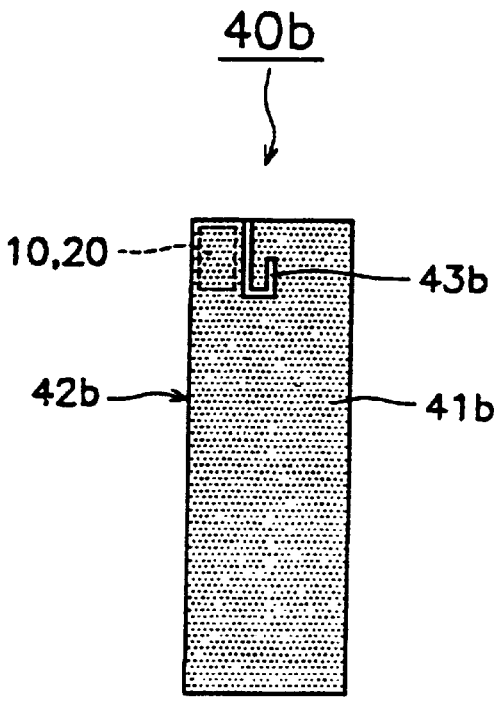
FIG. 15B is a perspective bottom view of another modification of the antenna device of FIG. 12.
Figure 16:
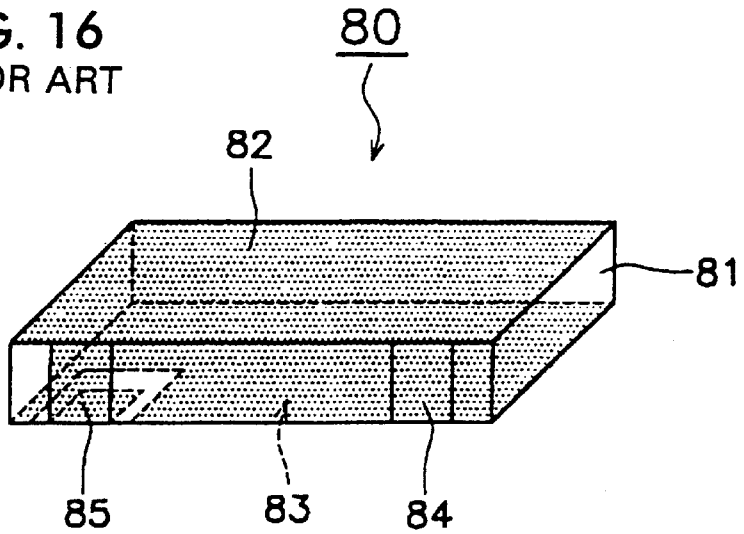
FIG. 16 PRIOR ART
FIG. 16 is a perspective view of a conventional, inverted F antenna.

Furthermore, although the case where the shape of the gap part is substantially an L-shape, which is bent in the direction in which the chip antenna is not mounted, was described with the antenna device of the second embodiment, the same effects may be obtained if the shape of gap part 43*a* or 43*b* is substantially an L-shape (FIG. 15(*a*)) or substantially a J-shape (FIG. 15(*b*)) that is bent in the direction in which chip antenna 10 is mounted.

While the invention has been particularly shown and described with reference to preferred embodiments thereof, it will be understood by those skilled in the art that the forgoing and other changes in form and details may be made therein without departing from the spirit of the invention.

What is claimed is:

1. A chip antenna, comprising:

a substrate made by laminating a plurality of sheet layers made of ceramic;

a radiating conductor having a substantially planar shape and provided on said substrate;

a grounding conductor having a substantially planar shape and provided so as to oppose said radiating conductor with said sheet layers interposed in between;

a capacitor conductor having a substantially planar shape and provided so as to oppose said radiating conductor with at least one of said sheet layers interposed in between;

a first shorting conductor which connects said radiating conductor and said grounding conductor;

a second shorting conductor which connects said grounding conductor and said capacitor conductor;

a feed terminal connected to at least one of said radiating conductor and said capacitor conductor; and a ground terminal connected to said grounding conductor.

2. The chip antenna according to claim 1, wherein a plurality of said radiating conductors are provided and at least one of said radiating conductors is fed.

3. An antenna device, comprising:

the chip antenna according to claim 1 or claim 2; and a mounting circuit board, having a protruding part extending from the end part thereof;

said chip antenna being mounted to one of the main surfaces of said protruding part and there being a ground electrode provided on the other main surface of said mounting circuit board.

4. Mobile communication apparatus, wherein the antenna device according to claim 3 is used.

5. An antenna device, comprising:

the chip antenna according to claim 2; and a mounting circuit board, having a protruding part extending from the end part thereof;

said chip antenna being mounted to one of the main surfaces of said protruding part and there being a ground electrode provided on the other main surface of said mounting circuit board.

6. Mobile communication apparatus, wherein the antenna device according to claim 4 is used.

7. An antenna device, comprising:

the chip antenna according to claim 2; and a mounting circuit board having said chip antenna mounted on one of the main surfaces thereof and having a ground electrode provided on the other main surface thereof;

said ground electrode having a gap part in the vicinity of the location at which the chip antenna is mounted.

8. Mobile communication apparatus, wherein the antenna device according to claim 6 is used.

9. An antenna device, comprising:

the chip antenna according to claim 1; and a mounting circuit board having said chip antenna mounted on one of the main surfaces thereof and having a ground electrode provided on the other main surface thereof;

said ground electrode having a gap part in the vicinity of the location at which the chip antenna is mounted.

10. Mobile communication apparatus, wherein the antenna device according to claim 5 is used.

11. The chip antenna according to claim 1, wherein the capacitor conductor has a capacitance and an area, the capacitance being adjusted by a gap comprising a thickness of a dielectric layer between the radiating conductor and the capacitor conductor, and the overlapping amount of the radiating conductor and the capacitor conductor, the area of the capacitor conductor being not larger than that of the radiating conductor.

* * * * *